US005374210A

United States Patent [19]

Sardella et al.

[11] Patent Number: 5,374,210

[45] Date of Patent: Dec. 20, 1994

[54] BREAST-STROKE FINS

[76] Inventors: Franco Sardella, 5 Via Tripoli, Rome; Mario Menghi, 8 Via Monte Livata, Guidonia (RM); Ivo Ferretti, 47 Via della Vigne, Rome, all of Italy

[21] Appl. No.: 225,546

[22] Filed: Apr. 11, 1994

[51] Int. Cl.[5] ..... A63B 31/08

[52] U.S. Cl. ..... 441/64

[58] Field of Search ..... 441/61-64; D21/239

[56] References Cited

U.S. PATENT DOCUMENTS

| | | | |
|---|---|---|---|
| 855,377 | 5/1907 | Ayers | 441/62 |
| 1,043,776 | 11/1912 | Larson | 441/61 |
| 1,590,484 | 6/1926 | Völker | 441/61 |
| 1,702,681 | 2/1929 | Barbosa | 441/62 |
| 1,829,868 | 11/1931 | Lamprecht | 441/61 |

*Primary Examiner*—Edwin L. Swinehart

*Attorney, Agent, or Firm*—Leonard Bloom

[57] ABSTRACT

Breast-stroke swimming fine consisting of a flexible rubber shoe having a short rigid wing at the front with twisted profile and an oscillating rigid wall under one of the fin sides.

1 Claim, 1 Drawing Sheet

BREAST-STROKE FINS

FIELD OF THE INVENTION

This patent application concerns breast-stroke swimming fins.

DESCRIPTION OF THE RELATED ART

The invention is an absolute novelty in the swimming accessory sector in that to date the only type of fins known and used are those designed for swimming styles like freestyle or underwater swimming, where the swimmer keeps his legs well extended and adjacent, kicking them alternatively.

It is common knowledge that conventional fins are manufactured entirely in rubber and consist of a shoe having a flexible trapezoid wing at the front whose width gradually fans out.

In view of their shape, conventional fins can only be used for swimming styles where the legs are fully extended and kicked alternatively, such as freestyle, backstroke or underwater swimming.

These conventional fins can not however be used for breast-stroke whereby the swimmer opens and closes his legs at the same time, in that the fins will slow down the swimmer.

A brief description is given of the breast-stroke movements: in the first phase the legs are completely extended; the legs are then pulled up, opening the knees but with heels joined, both legs are then pushed outwards and upwards hard with the feet practically perpendicular to the calves (hammer position), and then fully extended again.

The advantages of the fins according to the invention in the case of breast-stroke, are clearly explained in the description which refers to the enclosed tables that are provided for purposes of illustration and not in a limiting sense.

DESCRIPTION OF THE PREFERRED EMBODIMENT

Figure 1:
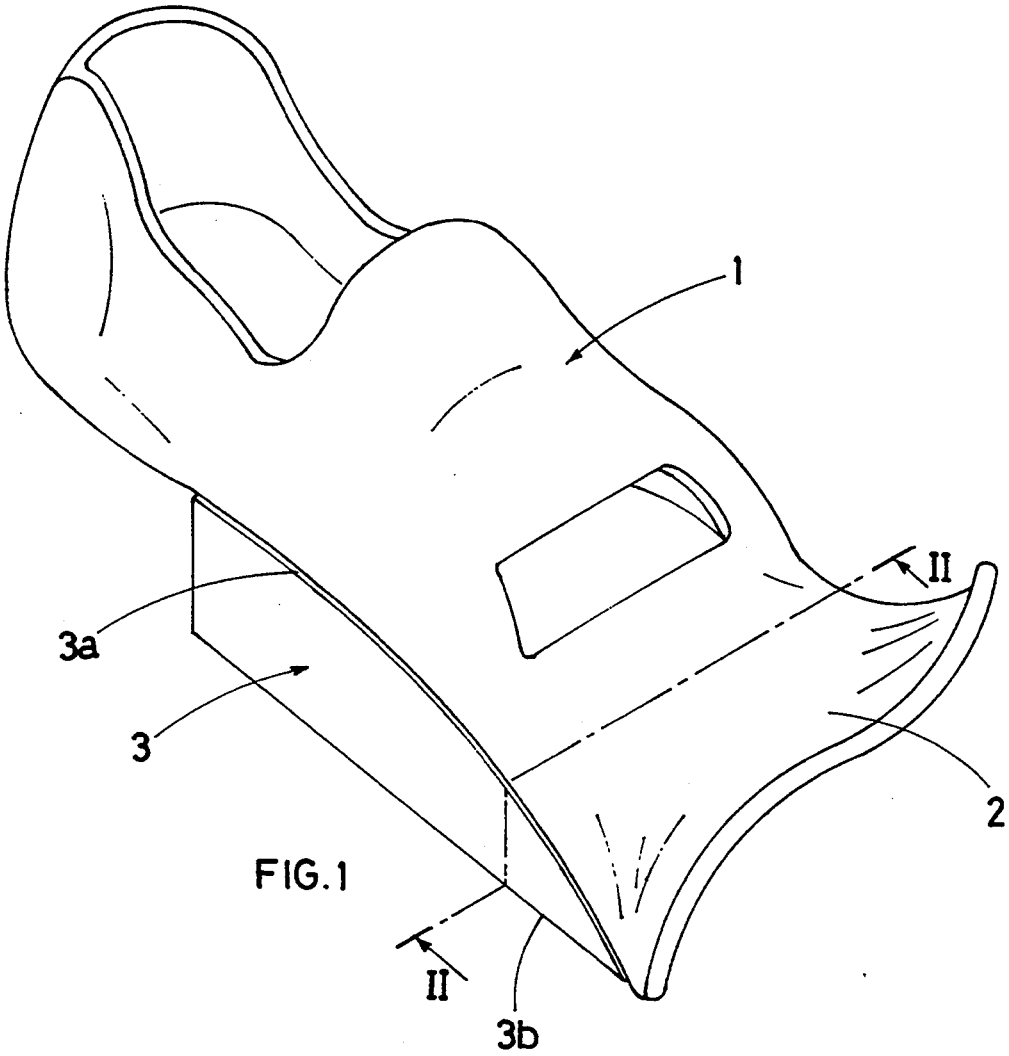
FIG. 1 is a front view of a right hand fin with a detail of the right hand side.
Figure 2:
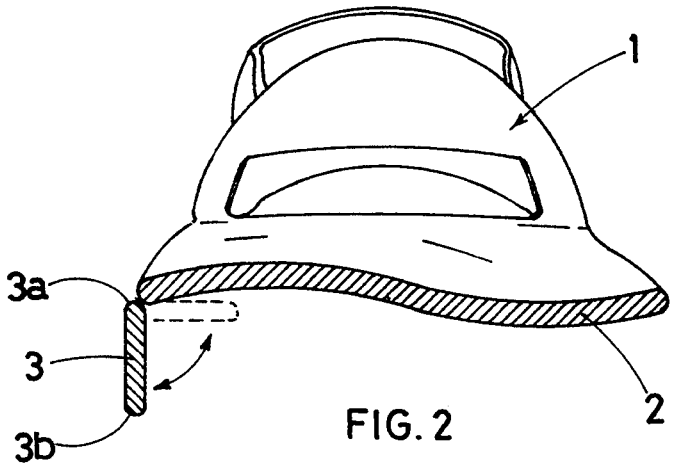
FIG. 2 is a cross-section of FIG. 1 on plane II—II.

With reference to the above figures, the fins according to the invention consist of a conventional flexible rubber shoe (1) having a short rigid wing (2) at the front with an almost rectangular section and twisted profile.

The internal corner of said wing (2) is turned upwards and the external corner is turned downwards.

The external side of the shoe (1) has on the underneath a rigid oscillating wall (3) whose upper edge (3*a*) is characterized by a profile which, in one instance follows the length of the shoe (1), and then continues along the length of the downward corner of the front wing (2); the bottom edge (3*b*) of the wall (3) being almost rectilinear.

This wall (3) is in fact joined only to the shoe (1) by means of an internal hinge (that is not visible in the drawings) which allows the same to oscillate approximately 90° so that the same can move from a vertical position (aligned with the external side of the shoe) to an almost horizontal position (almost touching the sole of the shoe). The oscillation of the wall (3) is designed to form a propulsion profile when the legs are extended, without creating resistance when the legs are pulled up.

When the swimmer pushes his legs, the wall (3) opens automatically and is kept in its final vertical position by the pressure of the water mass pushed by the swimmer as he kicks his legs outwards and upwards; obviously, in this phase and in this vertical position, it will obviously increase propulsion.

When the legs are retracted, the water pressure, this time on the external face of the wall (3), automatically closes this component towards the sole of the shoe; in other words, the wall (3) moves into a position whereby no resistance is created with respect to the retraction of the legs.

The twisted profile of the rigid front wing (2) is designed on the basis of this very hydrodynamic principle; in view of the complex and articulated movement of the foot during retraction of the legs, the twisted profile of the rigid front wing (2) increases propulsion during the outward and upward movement of the legs, without creating resistance during the downward movement.

In particular, when the swimmer kicks out, the bottom surface of the twisted wing (2), and above all the downward corner, acts as a concave blade, which moves a major volume of water thereby creating major propulsion, even if with major physical effort; on the contrary, during retraction of the legs, the upper surface of the wing (3), slides smoothly in the water without creating friction, thanks to its convex shape.

What is claimed is:

1. A fin for swimming breast-stroke consisting of a flexible rubber shoe (1) having a short rigid wing (2) projecting from the front, characterized by a substantially rectangular section and twisted profile having an internal corner bending upwards and an external corner bending downwards; the external side of the shoe (1) having underneath a rigid oscillating wall (3) whose upper edge (3*a*) is characterized by a profile which follows the length of the shoe (1) and then continues along the downward corner of the front wing (2); the bottom edge (3*b*) of the wall (3) being substantially rectilinear; said wall (3) joined to the shoe (1) by means of an internal hinge being able to oscillate approximately 90° to move from a vertical position to a substantially horizontal position.

* * * * *